US009203172B2

(12) United States Patent
Kubo et al.

(10) Patent No.: US 9,203,172 B2
(45) Date of Patent: Dec. 1, 2015

(54) ELECTRICAL CONNECTOR ASSEMBLY AND ELECTRICAL CONNECTOR USED THEREFOR

(71) Applicant: Tyco Electronics Japan G.K., Kanagawa (JP)

(72) Inventors: Akira Kubo, Kanagawa (JP); Hiroshi Takeuchi, Tokyo (JP); Yoshihiko Shino, Kanagawa (JP); Yoshihiko Kodaira, Kanagawa (JP); Hiroshi Shirai, Saitama (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 14/172,529

(22) Filed: Feb. 4, 2014

(65) Prior Publication Data

US 2014/0220830 A1 Aug. 7, 2014

(30) Foreign Application Priority Data

Feb. 5, 2013 (JP) ..... 2013-020086
Jun. 11, 2013 (JP) ..... 2013-122323

(51) Int. Cl.

*H01R 13/04* (2006.01)
*H01R 12/71* (2011.01)
*H01R 12/73* (2011.01)
*H01R 13/10* (2006.01)

(52) U.S. Cl.

CPC ..... *H01R 13/04* (2013.01); *H01R 12/716* (2013.01); *H01R 12/73* (2013.01); *H01R 13/10* (2013.01)

(58) Field of Classification Search

CPC ..... H01R 12/73; H01R 13/10; H01R 13/04; H01R 12/716
USPC ..... 439/660, 74, 295, 66, 342, 70–71, 439/733.1
See application file for complete search history.

(56) References Cited

U.S. PATENT DOCUMENTS 7,455,556 B2 11/2008 Mendenhall et al.
7,465,171 B2 * 12/2008 Miyazaki et al. ..... 439/74
7,748,993 B2 * 7/2010 Midorikawa et al. ..... 439/74
7,927,158 B2 4/2011 Kim et al.

(Continued)

FOREIGN PATENT DOCUMENTS

EP 1126554 A2 5/2001
EP 0902994 B1 11/2001

(Continued)

OTHER PUBLICATIONS

European Patent Office Search Report, Application No. 14153336.4-1801, dated May 2, 2014, 7 pages.

(Continued)

*Primary Examiner* — Edwin A. Leon
(74) *Attorney, Agent, or Firm* — Barley Snyder

(57) ABSTRACT

An electrical connector assembly is provided with a plug connector and a receptacle connector. The plug connector includes a housing and a plurality of conductive plug terminals arranged along a row in the housing. The receptacle connector includes a receptacle housing, a plurality of conductive receptacle terminals arranged along a row in the receptacle housing by an equidistance pitch, and a solder peg having a contact portion arranged along the row of the plurality of conductive receptacle terminals at a distance equal to the equidistance pitch.

17 Claims, 9 Drawing Sheets

(56) References Cited

U.S. PATENT DOCUMENTS

| | | | | |
|---|---|---|---|---|
| 7,993,146 | B2 * | 8/2011 | Midorikawa | 439/74 |
| 8,267,698 | B2 * | 9/2012 | Ishikawa et al. | 439/17 |
| 8,469,722 | B2 * | 6/2013 | Huang | 439/74 |
| 8,758,029 | B2 * | 6/2014 | Midorikawa | 439/74 |
| 2011/0263140 | A1 | 10/2011 | Sato et al. | |

FOREIGN PATENT DOCUMENTS

| | | | |
|---|---|---|---|
| EP | 1965466 | A2 | 9/2008 |
| EP | 2224541 | A1 | 9/2010 |
| JP | 1050371 | A | 2/1998 |
| JP | 200550702 | A | 2/2005 |
| JP | 2011243332 | A | 12/2011 |
| WO | 2004055944 | A1 | 1/2004 |
| WO | 2011142132 | A1 | 11/2011 |
| WO | 2012006086 | A2 | 12/2012 |

OTHER PUBLICATIONS

PCT Notification of Transmittal of the International Search Report and the Written Opinion of the International Searching Authority, or the Declaration for International Application No. PCT/EP2012/065345, dated Nov. 20, 2012, 17 pages.

* cited by examiner (A)

(B)

(C)

(D)

(A)

(B)

(C)

(D)

(A)

(B)

(C)

(A)

(B)

(C)

ELECTRICAL CONNECTOR ASSEMBLY AND ELECTRICAL CONNECTOR USED THEREFOR

CROSS-REFERENCE TO RELATED APPLICATIONS

This application claims the benefit of the filing date under 35 U.S.C. §119 to Japanese Patent Application No. 2013-20086 filed on of Feb. 5, 2013 and Japanese Patent Application No. 2013-122323 filed on Jun. 11, 2013

FIELD OF INVENTION

The invention relates to a to an electrical connector assembly and, in particular, to an electrical connector assembly having a receptacle connector having a solder peg.

BACKGROUND

An electrical connector assembly having a pair of mating electrical connectors mounted on a pair of boards, respectively, is well known and used to electrically interconnect the pair of boards. One or both of the pair of electrical connectors generally have a solder peg or solder pegs to secure bonding strength (mounting strength) to the boards. The solder peg not only secures bonding strength to the board, but also may have an electrically-conductive function for ground connection (see Japanese Patent No. JP 10-50371 A), or may function as a mating completion detecting switch (see Japanese Patent Application No. JP 2011-243332 A).

However, space is required to accommodate the solder peg in a housing of the electrical connector. In particular, if the solder pegs are provided in both of the pair of electrical connectors, downsizing is difficult.

SUMMARY

Accordingly, the present invention has been made in view of the above problem, and an object of invention, among others, is to provide an electrical connector assembly having a plug connector and a receptacle connector. The plug connector includes a housing and a plurality of conductive plug terminals arranged along a row in the housing. The receptacle connector includes a receptacle housing, a plurality of conductive receptacle terminals arranged along a row in the receptacle housing by an equidistance pitch, and a solder peg having a contact portion arranged along the row of the plurality of conductive receptacle terminals at a distance equal to the equidistance pitch.

BRIEF DESCRIPTION OF THE DRAWINGS

The invention is explained below by way of example with reference to embodiments and the drawings. The various features of the configurations can be combined independently of each other, as has already been set out in the individual advantageous configurations. In the drawings.

DETAILED DESCRIPTION OF THE EMBODIMENT(S)

Figure 1:
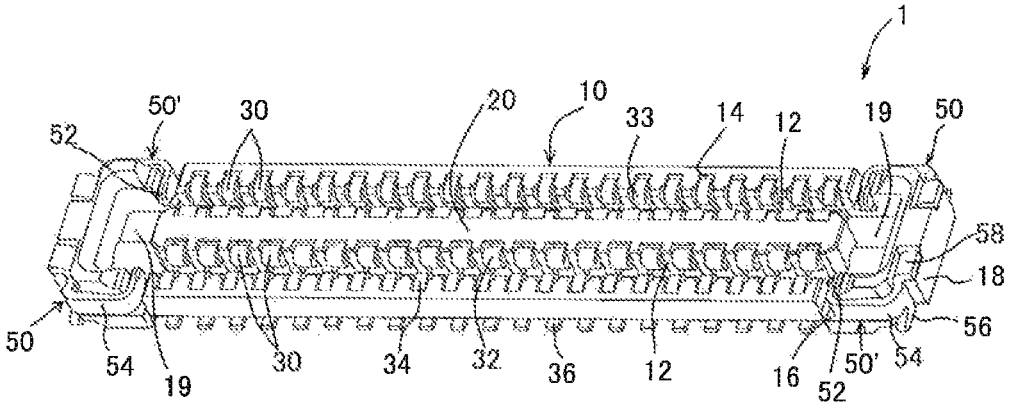
FIG. 1 is a perspective view showing a receptacle connector of an electrical connector assembly according to the invention.
Figure 2:
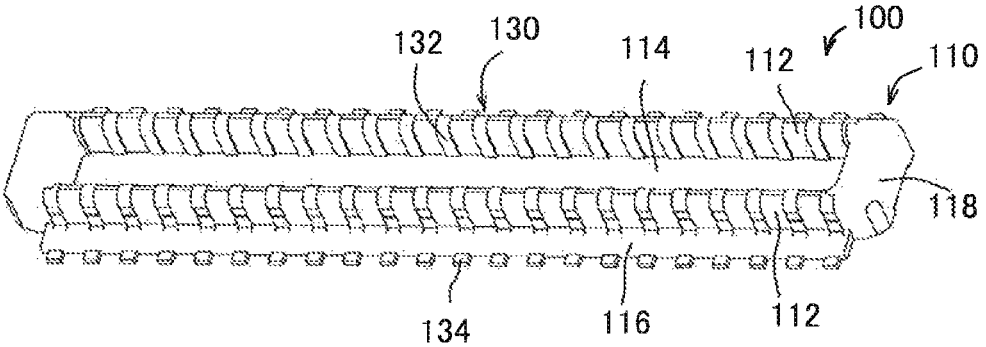
FIG. 2 is a perspective view showing a plug connector of the electrical connector assembly according to the invention.

The invention will be described below by way of example with reference to the attached drawings.

With reference to FIGS. 1 and 3A to 3D, a receptacle connector 1 includes a housing 10, a total of 40 conductive terminals 30 arranged in two rows in the housing 10, and two solder pegs 50, 50' provided at each end of the housing 10. The housing 10 is molded from synthetic resin, such as liquid crystalline polymer, and has an approximately rectangular parallelepiped shape as a whole. Two rows of passageways 12 extending in an elongated direction of the housing 10 are formed in the housing 10, and terminal receiving passageways 14 receiving each conductive terminal 30 that communicate with the passageway 12.

The conductive terminal 30 is stamped and formed from sheet metal having elasticity and good conductivity, such as copper alloy, and has contact portions 32, 33 having an approximately U shape as viewed from the side, a securing portion 34, and a surface-mounting type solder connection portion 36. The conductive terminals 30 are positioned in two rows along the passageways 12. The securing portion 34 of each conductive terminal 30 is press fitted in each terminal receiving passageway 14. The conductive terminals 30 are positioned at a predetermined pitch $P_1$ in each row.

Figure 5:
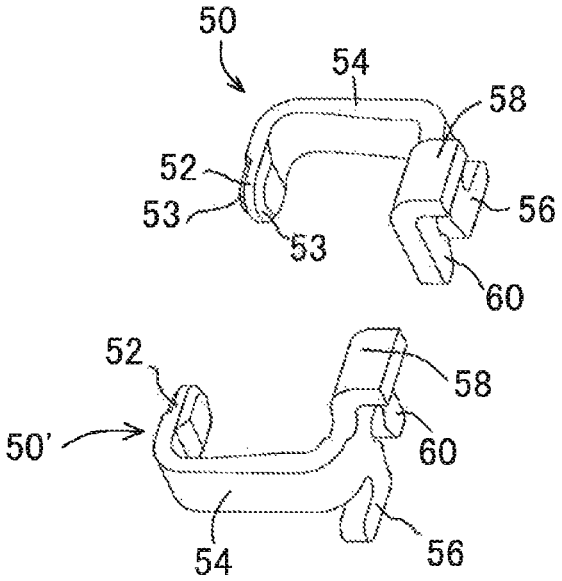
FIG. 5 is a perspective view showing solder pegs of the receptacle connector of the invention.

With reference to FIG. 5, each of the solder pegs 50, 50' is stamped and formed from sheet metal having elasticity and good conductivity and thicker than the thickness of the conductive terminal 30. The solder pegs 50, 50' are mirror-symmetrical, and therefore only one solder peg 50 will be described below. The solder peg 50 has a spring arm 54 having an approximately C shape as viewed from the top and having a contact portion 52 formed at a distal end, a solder connection portion 56, a stop 58, and a press-fit portion 60. The solder peg 50 is received in a peg receiving recess 16 at each longitudinal end of the housing 10, and secured to the housing 10 with the press-fit portion 60. Two edges of the contact portion 52 are chamfered 53. The spring arm 54 is so formed by rolling as to be partially thinner than the contact portion 52. Thus, overstress that may occur in the spring arm 54 can be avoided, so that plastic deformation of the spring arm 54 is prevented. Since there is no wall of the housing 10 outside the spring arm 54 (a vertical direction in FIG. 3A), the spring arm 54 can deflect outward without being inhibited by the housing 10. The stop 58 of the solder peg 50 is disposed on an upper face of a mount 18 positioned on each end of the housing 10 to prevent the solder peg 50 from falling down outward in the longitudinal direction of the housing 10. A distance (or pitch) between the center line of the contact portion 52 of the solder peg 50 and the center line of the conductive terminal 30 adjacent thereto is $P_2$, and $P_2$ is equal to $P_1$ of the conductive terminals 30. It should be noted that since the thicknesses of the solder pegs 50, 50' are thicker than those of the conductive terminals 30, the bonding strength of the solder pegs 50, 50' to the board is higher than that of the conductive terminals 30.

Next, with reference to FIGS. 2 and 4A to 4D, the plug connector 100 includes a housing 110 and a total of 44 conductive terminals 130 arranged in two rows in the housing 110. The housing 110 is molded from synthetic resin, such as liquid crystalline polymer. Two ridges 112, 112 and a receiving passageway 114 between these ridges 112, 112 are formed in the housing 110. The passageway 114 receives a ridge 20 (see FIG. 1) of the receptacle connector 1 when the receptacle connector 1 and the plug connector 100 are mated with each other.

The conductive terminal 130 is stamped and formed from sheet metal having good conductivity, such as copper alloy, and has a contact portion 132 having an inverted U shape as viewed from the side and a surface-mounting type solder connection portion 134. The contact portion 132 is inserted between the contact portions 32, 33 of the conductive terminal 30 when the receptacle connector 1 and the plug connector 100 are mated with each other. The conductive terminals 130 are positioned in two rows along the two ridges 112. The solder connection portion 134 of each conductive terminal 130 is secured to a strip-like portion 116 extending horizontally from a side of the housing 110. The securing of the solder connection portion 134 to the strip-like portion 116 is performed by insert-molding the conductive terminals 130 to the housing 110. The conductive terminals 130 are positioned in each row at the same pitch $P_1$ as the arrangement pitch of the conductive terminals 30 of the receptacle connector 1. The plug connector 100 is not provided with a solder peg. Since the conductive terminals 130 are insert-molded in the housing 110, it is very unlikely that the conductive terminals 130 may come off from the housing 110 even if external force is applied to the plug connector 100 mounted on the board. Since the plug connector 100 does not need a solder peg, and includes only the conductive terminals 130 in the same shape in addition to the housing 110, it is possible to manufacture the plug connector 100 at low cost.

Figure 3:
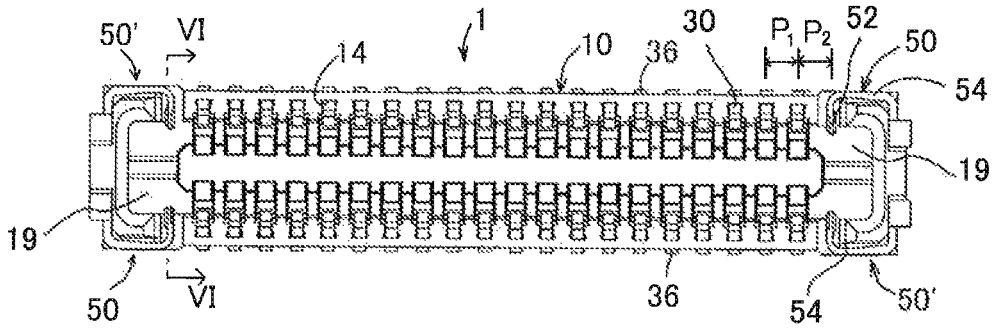
FIG. 3A is a plan view showing the receptacle connector of FIG. 1.
FIG. 3B is a front view of the receptacle connector of FIG. 1.
FIG. 3C is a bottom view of the receptacle connector of FIG. 1.
FIG. 3D is a right side view of the receptacle connector of FIG. 1.
Figure 3:
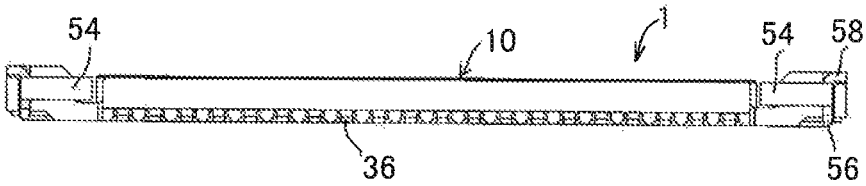
Figure 3:
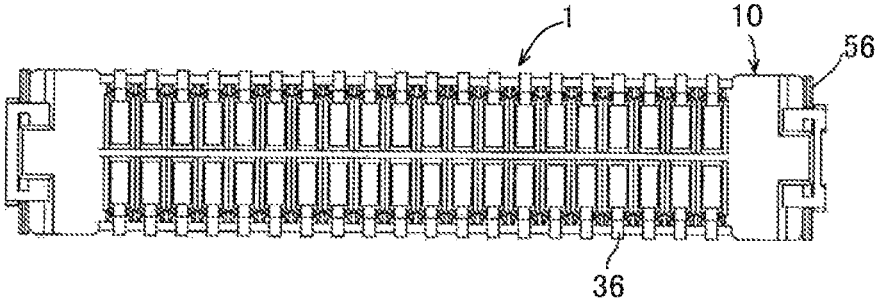
Figure 3:
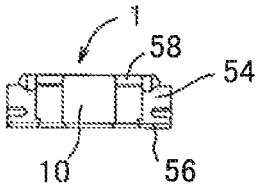
Figure 4:
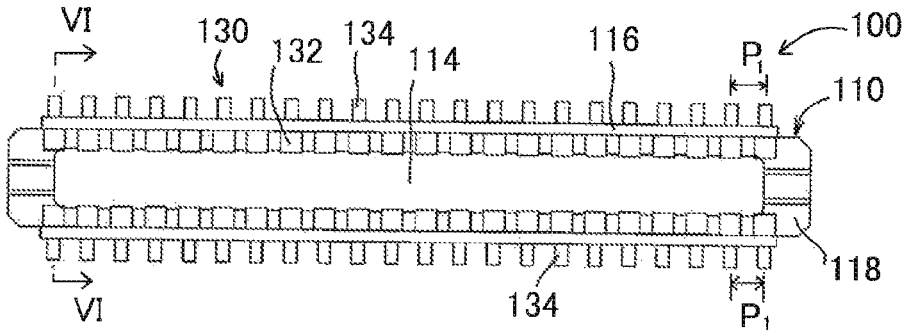
FIG. 4A is a plan view of the plug connector of FIG. 2.
FIG. 4B is a front view of the plug connector of FIG. 2.
FIG. 4C is a bottom view of the plug connector of FIG. 2.
FIG. 4D is a right side view of the plug connector of FIG. 2.
Figure 4:
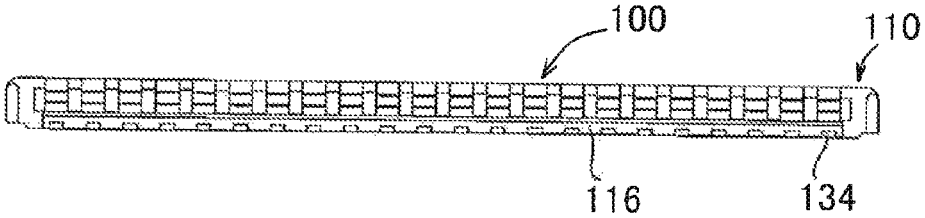
Figure 4:
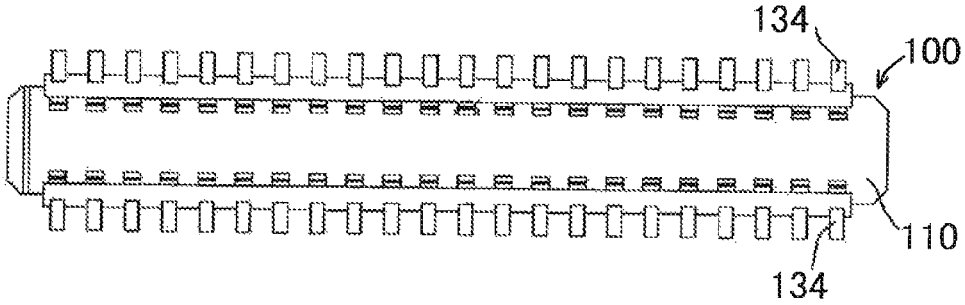
Figure 4:
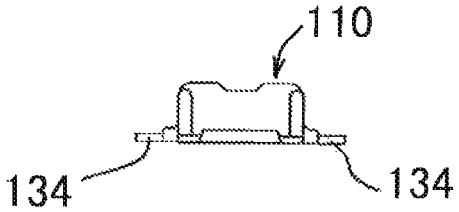
Figure 6:
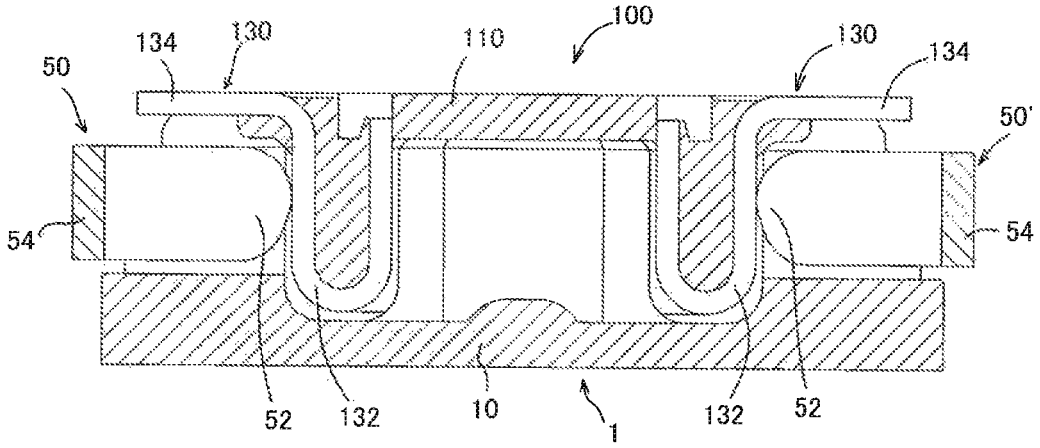
FIG. 6 is a sectional view of the electrical connector assembly when the receptacle connector and plug connector are mated, taken along a line VI-VI in FIGS. 3A and 4A.
Figure 7:
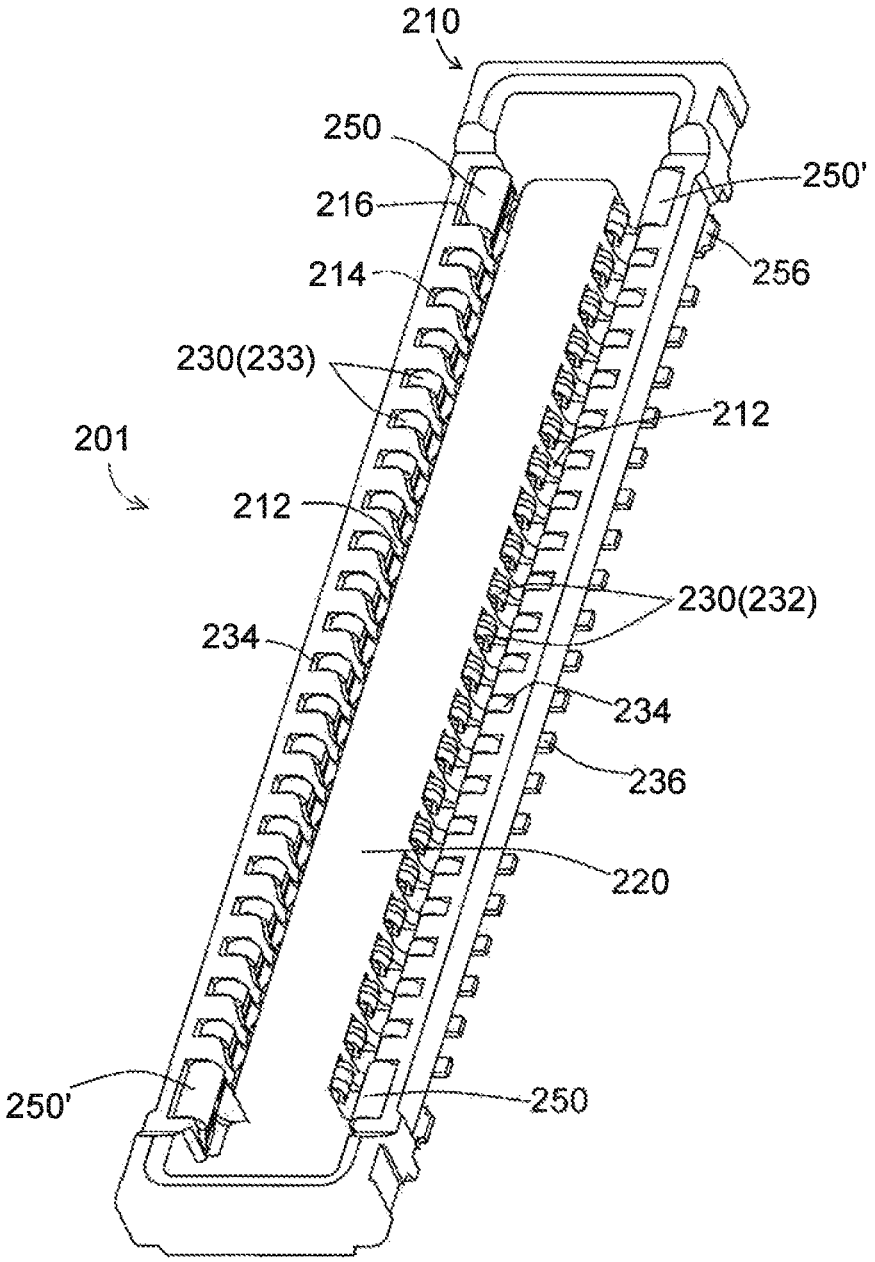
FIG. 7 is a perspective view showing another receptacle connector of an electrical connector assembly according to the invention.
Figure 8:
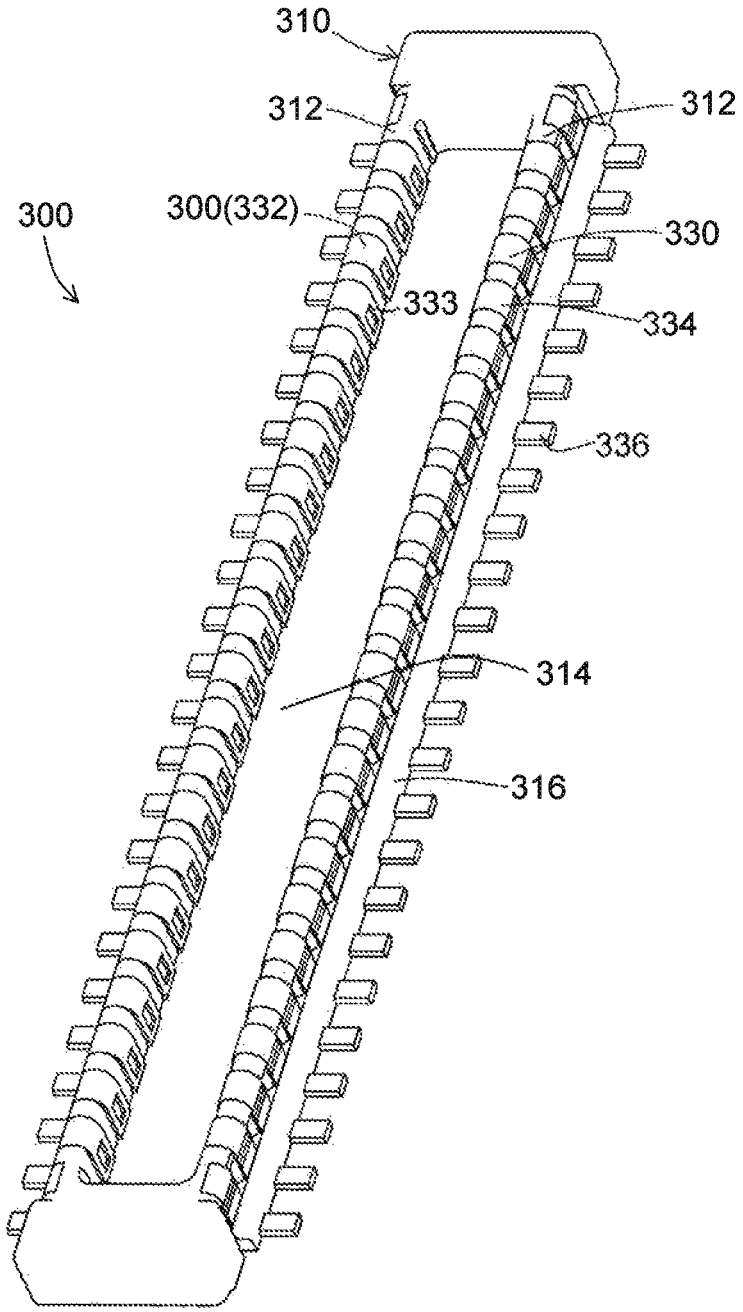
FIG. 8 is a perspective view showing another plug connector of the electrical connector assembly according to the present invention.
Figure 9:
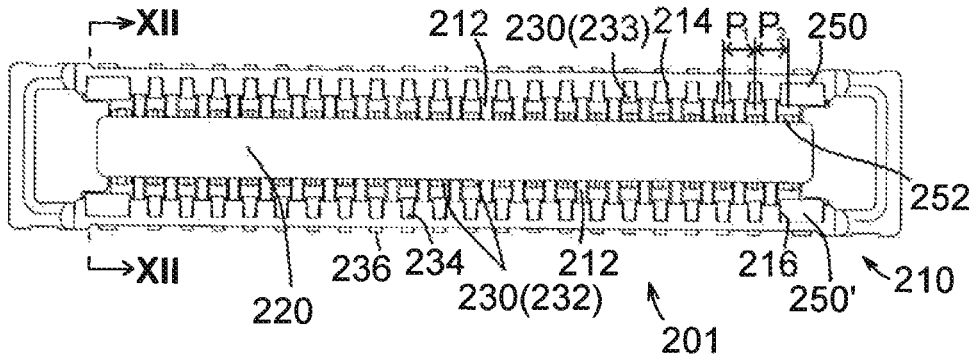
FIG. 9A is a plan view showing the receptacle connector of FIG. 7.
FIG. 9B is a front view showing the receptacle connector of FIG. 7.
FIG. 9C is a bottom view showing the receptacle connector of FIG. 7.
Figure 9:
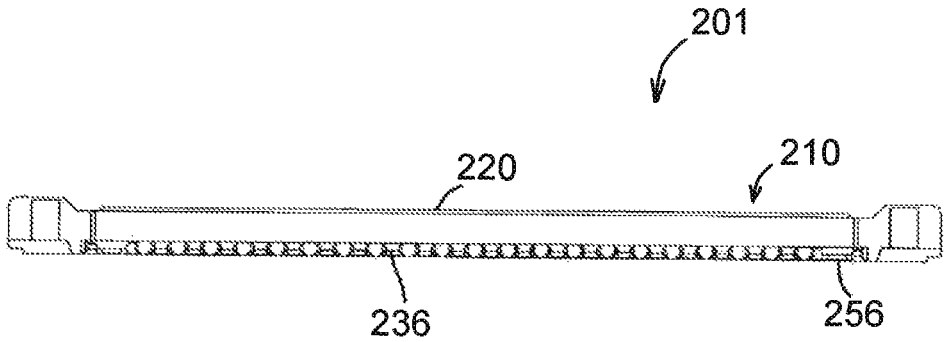
Figure 9:
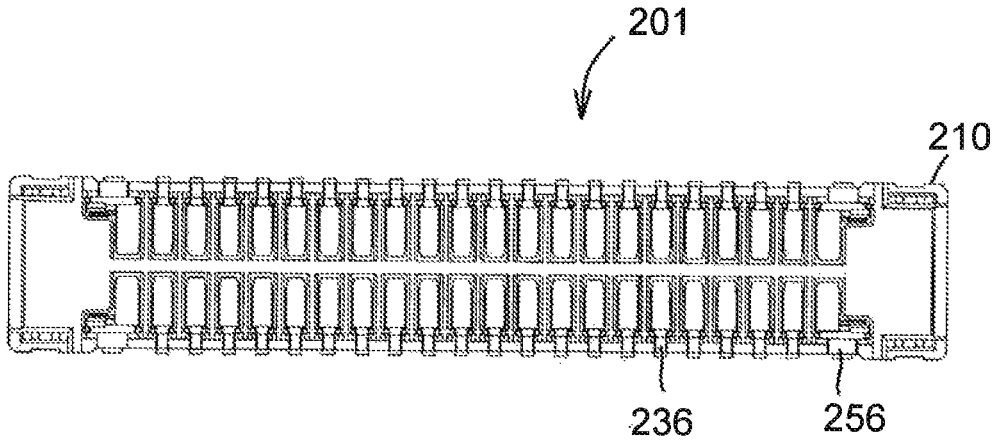
Figure 10:
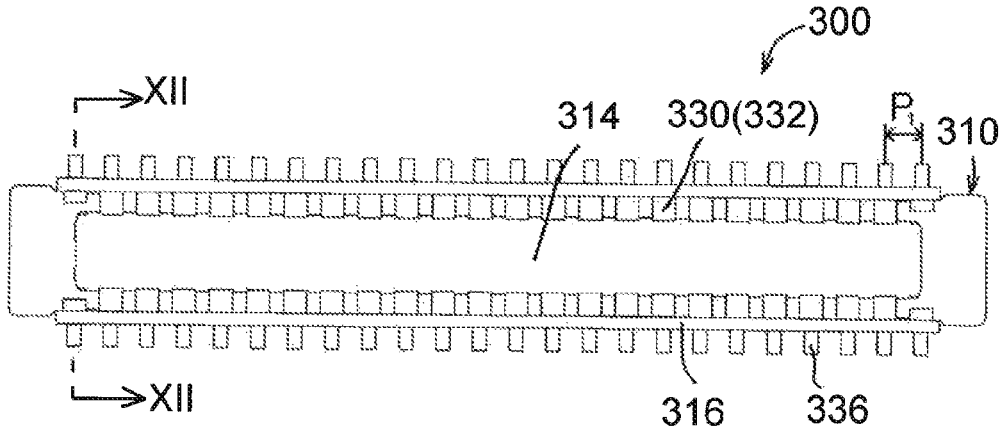
FIG. 10A is a plan view showing the plug connector of FIG. 8.
FIG. 10B is a front view showing the plug connector of FIG. 8.
FIG. 10C is a bottom view showing the plug connector of FIG. 8.
Figure 10:
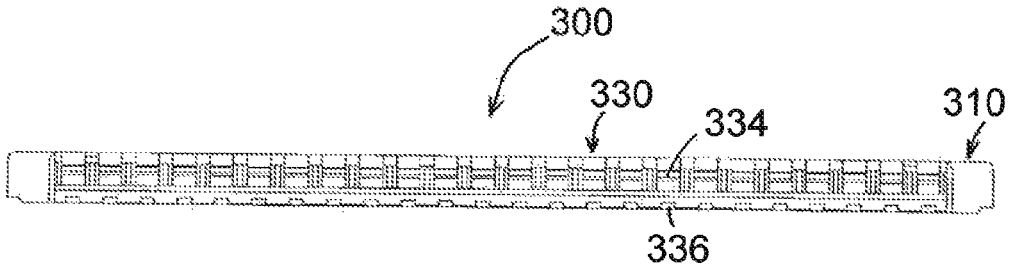
Figure 10:
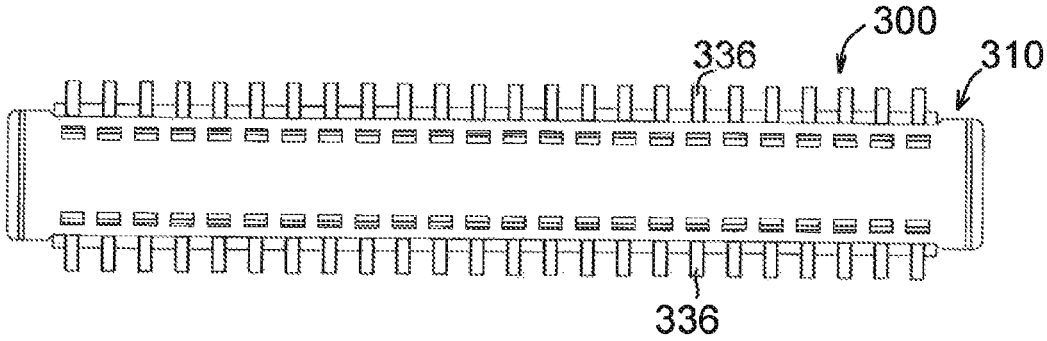

With respect to Figure, the receptacle connector 1 and the plug connector 100 are mated with each other, the conductive terminals 130 of the plug connector 100 (excluding the conductive terminals 130 at both longitudinal ends) come into contact with the conductive terminals 30 of the receptacle connector 1. In addition, the conductive terminals 130 at both longitudinal ends of the plug connector 100, as shown in FIG. 6, come into contact with the contact portions 52 of the solder pegs 50, 50' of the receptacle connector 1. As shown in FIG. 3A, the pitch $P_2$ between the conductive terminal 30 and the contact portion of the solder peg 50, 50' is equal to the pitch $P_1$ between the conductive terminals 30. Further, the pitch of the conductive terminals 130 of the plug connector 100 coming into contact with the conductive terminals 30 and the contact portions 52 of the solder pegs 50, 50' is also the constant pitch $P_1$. Thus, even if the solder pegs 50, 50' are used as conductive terminals, it is possible to downsize the electrical connector assembly (in particular, the plug connector 100). Therefore, it is possible to reduce a connector occupancy area on the board on which the receptacle connector 1 and the plug connector 100 are mounted.

From another point of view, the C-shaped spring arm can be set relatively long, so that contact reliability between the contact portions 52 of the solder pegs 50, 50' and the conductive terminals 130 is improved. It should be noted that, since the solder pegs 50, 50' are formed of sheet metal having a thicker thickness than the conductive terminals 30, the solder pegs 50, 50' have higher bonding strength to the board.

Next, another electrical connector assembly according to invention will be described, with respect to FIGS. 7-12. It should be noted that differences from the electrical connector assembly described above will be particularly described, and that descriptions of elements equivalent to those of the electrical connector assembly described above may be omitted.

With reference to FIGS. 7 and 9A to 9C, the receptacle connector 201 includes a housing 210, a total of 40 conductive terminals 230 arranged in two rows in the housing 210, and two solder pegs 250, 250' provided at each end of the housing 210. The housing 210 is molded from synthetic resin, such as liquid crystalline polymer, and has an approximately rectangular parallelepiped shape as a whole. Two rows of passageways 212 extending in an elongated direction of the housing 210 are formed in the housing 210, and terminal receiving passageways 214 receiving each conductive terminal 30 communicate with the passageway 212. A ridge 220 extends in the elongated direction of the housing 210 between the two rows of passageways 212, 212. A top face of the ridge 220 is flat and relatively wide, and slightly higher than outer walls on both sides thereof (see FIG. 9B), so that the top face is easily accessed by a suction nozzle (not shown).

The conductive terminal 230 is stamped and formed from sheet metal having elasticity and good conductivity, such as copper alloy, and has contact portions 232, 233 having an approximately U shape as viewed from the side, a securing portion 234, and a surface-mounting type solder connection portion 236. The conductive terminals 230 are positioned in two rows along the passageways 212. The securing portion 234 of each conductive terminal 230 is press fitted in each terminal receiving passageway 214. The conductive terminals 230 are positioned in each row at a predetermined pitch $P_1$ (see FIG. 9A), for example, 0.35 mm or the like.

Figure 11:
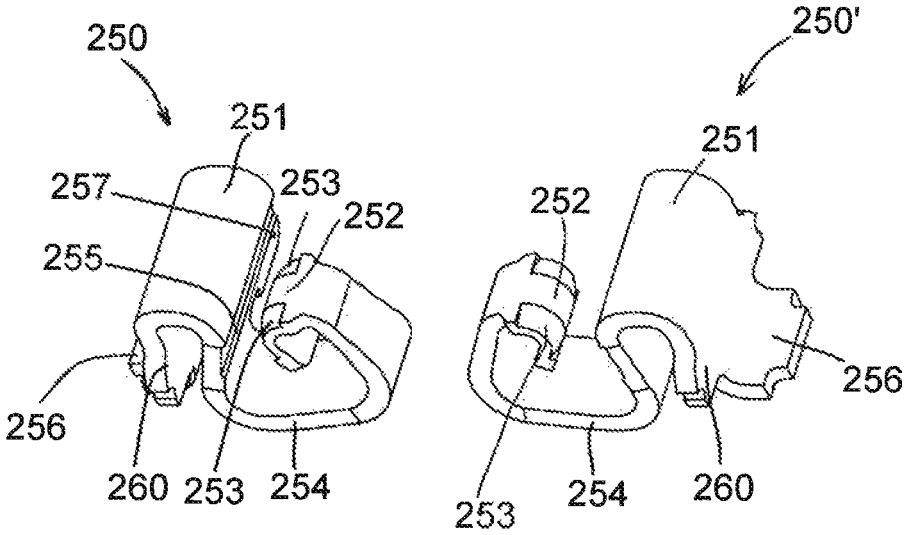
FIG. 11 is a perspective view showing solder pegs of the receptacle connector of FIG. 7.

With reference to FIG. 11, each of the solder pegs 250, 250' is stamped and formed from sheet metal having elasticity and good conductivity. The solder pegs 250, 250' are mirror-symmetrical, and therefore only one solder peg 250 will be described below. The solder peg 250 has a wider base 251 having a press-fit portion 260 in the configuration of a barb, a spring arm 254 extending from one widthwise side of the base 251, having a contact portion 252 formed at a distal end, and having an approximately U shape as viewed from the side, and a solder connection portion 256. The solder peg 250 is received in a peg receiving recess 216 in the vicinity of each longitudinal end of the housing 210, and secured to the housing 210 with the press-fit portion 260. Both sides of the contact portion 252 are chamfered (see a reference numeral 253). A distance (or pitch) between the center line of the contact portion 252 of the solder peg 250 and the center line of the conductive terminal 230 adjacent thereto is $P_2$, and $P_2$ (see FIG. 9A) is equal to the pitch $P_1$ of the conductive terminals 230. The solder peg 250 is press fitted to the housing 210 from a bottom side of the housing 210.

Next, with reference to FIGS. 8 and 10A to 10C, the plug connector 300 includes a housing 310, and a total of 48 conductive terminals 330 arranged in two rows in the housing 310. The housing 310 is molded from synthetic resin, such as liquid crystalline polymer. Two ridges 312, 312 and a passageway 314 between these ridges 312, 312 are formed in the housing 310. The passageway 314 receives the ridge 220 (see FIG. 7) of the receptacle connector 201 when the receptacle connector 201 and the plug connector 300 are mated with each other. A bottom face of the passageway 314 is flat and relatively wide, so that the bottom face is easily accessed by a suction nozzle.

The conductive terminal 330 is stamped and formed from sheet metal having good conductivity, such as copper alloy, and has a contact portion 332 having an inverted U shapes as viewed from the top and a surface-mounting type solder connection portion 336. The contact portion 332 is inserted between the contact portions 232, 233 of the conductive terminal 230 when the receptacle connector 201 and the plug connector 300 are mated with each other, and is brought into two-point contact at an inner contact point 333 and an outer contact point 334. The conductive terminals 330 are positioned in two rows along the two ridges 312. The solder connection portion 336 of each conductive terminal 330 is secured to a strip-like portion 316 extending horizontally from a side of the housing 310. The securing of the solder connection portions 336 to the strip-like portion 316 is performed by insert-molding the conductive terminals 330 to the housing 110. The conductive terminals 130 are positioned in each row at the same pitch $P_1$ as the arrangement pitch of the conductive terminals 230 of the receptacle connector 201 (see FIG. 10A). The plug connector 300 is not provided with a solder peg for the same reason as in the case of the plug connector 100. Since the plug connector 300 does not need a solder peg, and includes only the conductive terminals 330 in the same shape in addition to the housing 310, it is possible to manufacture the plug connector 300 at low cost.

Figure 12:
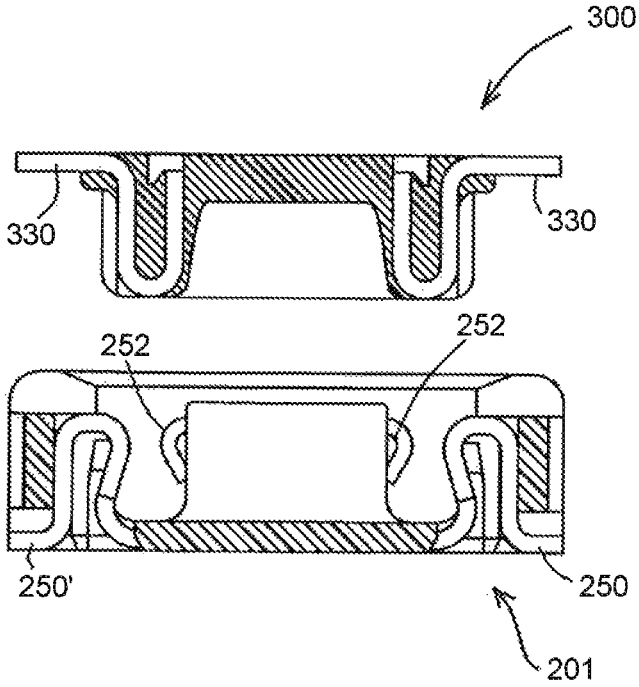
FIG. 12 is a sectional view of the electrical connector assembly when the receptacle connector and plug connector are mated, taken along a line XII-XII in FIGS. 9A and 10A.

FIG. 12 is a sectional view showing the electrical connector assembly (the receptacle connector 201 and the plug connector 300) before mating of the second embodiment of the present invention, taken along a line XII-XII in FIGS. 9A and 10A. When the receptacle connector 201 and the plug connector 300 are mated with each other, the conductive terminals 330 of the plug connector 300 (excluding the two conductive terminals 330 at both longitudinal ends) come into contact with the conductive terminals 230 of the receptacle connector 201. In addition, a total of two conductive terminals 330 at a longitudinal outermost end of the plug connector 300 and adjacent thereto (that is, the second conductive terminal from the outermost end) come into contact with the solder peg 250 (250') of the receptacle connector 201. As shown in FIG. 9A, the pitch $P_2$ between the conductive terminal 230 and the contact portion 252 of the solder peg 250 (250') is equal to the pitch $P_1$ between the conductive terminals 230. Further, the pitch of the conductive terminals 330 of the plug connector 300 coming into contact with the conductive terminal 230 and the contact portion 252 of the solder peg 250 (250') is also the constant pitch $P_1$. Thus, even when the solder peg 250 (250') is used as a conductive terminal, it is possible to downsize the electrical connector assembly (in particular, the plug connector 300). Therefore, it is possible to reduce a connector occupancy area on a board on which the receptacle connector 201 and the plug connector 300 are mounted.

The solder peg 250 (250') has a second contact point 255 at a position facing the contact portion 252 of the base 251, and a third contact point 257 at a position adjacent to the second contact point 255 on the other widthwise side of the base 251, in addition to the contact portion 252. When the receptacle connector 201 and the plug connector 300 are mated with each other, the contact portion 252 of the solder peg 250 (250') comes into contact with the inner contact point 333 of the second outermost conductive terminal 330 of the plug connector 300. Similarly, the second contact point 255 of the solder peg 250 (250') comes into contact with the outer contact point 334 of the second outermost conductive terminal 330 of the plug connector 300. Further, the third contact point 257 of the solder peg 250 (250') comes into contact with the outer contact point 334 of the outermost conductive terminal 330 of the plug connector 300. Thus, each solder peg 250 (250') comes into contact with two conductive terminals 330 of the plug connector 300 at three points in total, so that the solder peg 250 (250') is able to have relatively-large current-conduction capacity, for example, 1.2 A or the like. Therefore, the solder peg 250 (250') can be used as a power terminal.

The electrical connector assemblies and the electrical connectors (receptacle connectors) according to the embodiments of the invention have been described above in detail, but the invention is not intended to be limited to those embodiments, and can be modified variously. For example, the embodiments of the invention are board-to-board connectors, but also applicable to other types of connectors, such as a board-to-wire connector. It would be appreciated by those skilled in the art that various changes or modifications may be made in these embodiments without departing from the principles and spirit of the disclosure, the scope of which is defined in the claims and their equivalents.

What is claimed is:

1. An electrical connector assembly comprising:

a plug connector having a housing, and a plurality of conductive plug terminals arranged along a row in the housing; and a receptacle connector having a receptacle housing having a first end and an opposite second end, a plurality of conductive receptacle terminals positioned on the receptacle in a row extending from the first end to the second end, each being separated from each other by an equidistance pitch, and a solder peg positioned on the first end and the second end, and having a contact portion arranged along the row of the plurality of conductive receptacle terminals at a distance equal to the equidistance pitch.

2. The electrical connector assembly according to claim 1, wherein the plurality of conductive plug terminals are positioned at the same pitch as the plurality of conductive receptacle terminals.

3. The electrical connector assembly according to claim 1, wherein the solder peg includes a C-shaped spring arm.

4. The electrical connector assembly according to claim 3, wherein the contact portion extends from a distal end of the C-shaped spring arm.

5. The electrical connector assembly according to claim 4, wherein the C-shaped spring arm is thinner in thickness than the contact portion.

6. The electrical connector assembly according claim 1, wherein the solder peg is thicker in thickness than the plurality of conductive receptacle terminals.

7. The electrical connector assembly according to claim 1, wherein the solder peg includes a U-shaped spring arm extending from a side of the solder peg.

8. The electrical connector assembly according to claim 7, wherein the contact portion extends from a distal end of the U-shaped spring arm.

9. The electrical connector assembly according to claim 1, wherein an outermost conductive plug terminal of the plurality of conductive plug terminals contacts a base of the solder peg.

10. A receptacle connector, comprising:

a receptacle housing having a first end and an opposite second end, a plurality of conductive receptacle terminals positioned on the receptacle housing, and arranged along a row extending from the first end to the second end, each receptacle terminal being spaced apart by an equidistance pitch, and a solder peg positioned on the first end and the second end, and having a contact portion arranged along the row of the plurality of conductive receptacle terminals at a distance equal to the equidistance pitch.

11. The receptacle connector according to claim 10, wherein the solder peg includes a C-shaped spring arm.

12. The receptacle connector according to claim 11, wherein the contact portion extends from a distal end of the C-shaped spring arm.

13. The receptacle connector according to claim 12, wherein the C-shaped spring arm is thinner in thickness than the contact portion.

14. The receptacle connector according claim 10, wherein the solder peg is thicker in thickness than the plurality of conductive receptacle terminals.

15. The receptacle connector according to claim 10, wherein the solder peg includes a U-shaped spring arm extending from a side of the solder peg.

16. The receptacle connector according to claim 15, wherein the contact portion extends from a distal end of the U-shaped spring arm.

17. The receptacle connector according to claim 10, wherein an outermost conductive plug terminal of the plurality of conductive plug terminals contacts a base of the solder peg.

* * * * *